United States Patent [19]

Schmalz, Jr. et al.

[11] Patent Number: 4,817,649

[45] Date of Patent: Apr. 4, 1989

[54] PARTS WASHER DEVICE

[75] Inventors: Robert E. Schmalz, Jr., Roselle; Kenneth R. Luedtke, Chicago; Timothy E. Owens, Lombard, all of Ill.

[73] Assignee: Graymills Corporation, Chicago, Ill.

[21] Appl. No.: 179,024

[22] Filed: Apr. 7, 1988

[51] Int. Cl.[4] ..... B08B 3/04

[52] U.S. Cl. ..... 134/58 R; 134/113; 134/186; 134/195

[58] Field of Search ..... 134/58 R, 59, 111, 113, 134/174, 175, 186, 188, 191, 195

[56] References Cited

U.S. PATENT DOCUMENTS

| | | | |
|---|---|---|---|
| 2,352,356 | 6/1944 | Albertson | 134/191 X |
| 2,646,585 | 7/1953 | Whittington | 134/191 X |
| 3,016,841 | 1/1962 | Albertson et al. | 134/188 X |
| 3,522,814 | 8/1970 | Olson | 134/174 X |
| 4,016,893 | 4/1977 | Scott | 134/191 X |
| 4,029,115 | 6/1977 | Wheeler | 134/111 |
| 4,052,227 | 10/1977 | Delo et al. | 134/111 X |

*Primary Examiner*—Philip R. Coe

*Attorney, Agent, or Firm*—Wood, Dalton, Phillips, Mason & Rowe

[57] ABSTRACT

A parts washer device including a liquid container, a tank and a pump where the liquid container is adapted to carry a liquid solvent therein and has an open end defined by a rim and a closed end remote therefrom. The tank is adapted to be removably positioned on the liquid container such that parts can be washed therein and includes a parts washing portion adapted to be supported above the open end of the liquid container and a skirt portion extending below the parts washing portion and adapted to fit within the open end of said liquid container. The pump includes a pump discharge tube for carrying the liquid solvent from the liquid container to the parts washing portion of the tank and is mounted on the tank so as to extend through and substantially below the skirt portion into the liquid solvent when the tank is supported on the liquid container. In addition, the parts washer device is constructed such that the pump and pump discharge tube can be retracted into and retained within the skirt portion of the tank during removal of the tank from the liquid container.

25 Claims, 5 Drawing Sheets

PARTS WASHER DEVICE

FIELD OF THE INVENTION

The present invention is directed to devices for washing parts and, more particularly, to a parts washer device which facilitates the removal of a tank from a liquid container.

BACKGROUND OF THE INVENTION

Over the years, devices have been developed for the washing of parts in garages and automobile repair facilities and for industrial applications. These devices typically comprise a drum carrying a liquid solvent therein and a sink mounted over the drum and in which the parts can be washed. Generally speaking, it is conventional to provide a pump for delivering the solvent from the drum to the sink.

More particularly, the pump is typically secured to the sink to extend downwardly into the solvent in the drum. Thus, the pump normally extends well below the sink so as to draw solvent from a point closer to the bottom of the drum than the surface of the solvent after which the solvent passes through a tube to a hose that can be manipulated by the operator to wash the parts within the sink. As will be appreciated, the sink will have a drain for the solvent that is used to wash the parts to be returned to the drum.

By reason of the constant recirculation and use of the solvent in cleaning dirty parts, it is customary to service the solvent at intervals that depend upon the nature and extent of utilization of the parts washing device. Specifically, the solvent will become contaminated to an undesirable degree with grease, oil and other debris after a period of use which also depends upon the condition of the parts being washed. When this occurs, it is necessary to remove the sink from the drum to gain access to the solvent for servicing thereof.

Unfortunately, this operation is compounded by the position of the pump. The fact that the pump extends well below the bottom of the sink means that the sink must be lifted considerably above the top of the drum in order to effect the removal thereof, but this is not only a cumbersome and difficult act to perform but also can result in severe damage to the pump if it is knocked into the side of the drum during removal by reason of the failure to lift the sink sufficiently high for the pump to clear the open end of the drum. Moreover, even if the pump is made to clear the drum, the fact that it extends well below the sink is a serious problem.

In this connection, the sink must be set aside on a surface for the time period that is required for liquid solvent servicing. Since the pump extends below the sink, it can often be damaged when this is attempted which then, of course, necessitates downtime during repair or replacement of the pump and/or other operative components as well as the considerable costs necessarily resulting therefrom. As a result, it has remained to provide a truly effective parts washer device that overcomes the foregoing problems in an entirely satisfactory manner.

SUMMARY OF THE INVENTION

Accordingly, the present invention is directed to a parts washer device having a liquid container, a tank, a pump, and means for retracting and retaining the pump where the liquid container is adapted to carry a liquid solvent and has an opening defined by a rim and a closed end remote therefrom. The tank is adapted to be removably positioned on the liquid container such that parts can be washed therein and includes a parts washing portion adapted to be supported above the open end of the liquid container and a skirt portion extending below and adapted to fit within the open end of the liquid container. The pump is mounted on the tank so as to extend through and substantially below the skirt portion into the liquid solvent when the tank is supported on the liquid container and includes a pump discharge tube for carrying the liquid solvent from the liquid container to the parts washing portion of the tank. Furthermore, the parts washer device is such that the retracting and retaining means is capable not only of retracting the pump and pump discharge tube into the skirt portion of the tank but also retaining the pump and pump discharge tube within the skirt portion of the tank during removal of the tank from the liquid container.

In an exemplary embodiment, the retracting and retaining means includes a pump retraction cable extending from the pump to the tank or sink. The pump retraction cable is movable from a pump operative position to a pump retracted position prior to removal of the sink from the liquid container or drum and the retracting and retaining means further includes means for securing the pump retraction cable in either a pump operative position or a pump retracted position externally of the tank or sink at a point remote from the liquid solvent in the liquid container or drum. Advantageously, the cable securing means includes a pump retraction handle secured to the end of the pump retraction cable remote from the pump.

In this connection, the pump retraction cable passes through an opening in the sink dimensioned smaller than the pump retraction handle. Thus, the pump retraction handle is designed to be in engagement with the sink at the opening when the pump is in the pump operative position. The parts washer also preferably includes handle retention means for engagement with the pump retraction handle when the pump is in the pump retracted position. Suitably, the handle retention means is integrally associated with the sink in spaced relation to the opening. With this arrangement, the pump retraction cable is retractable through the opening to move the pump retraction handle from the opening to the handle retention means.

In a preferred embodiment, the parts washing portion of the sink includes a bottom wall entirely covering the skirt portion and a pump retraction cable pulley is mounted on the bottom wall within the confines of the skirt portion. Preferably, the pump retraction cable extends from the pump, over the pump retraction cable pulley, and through the opening in the sink, and the opening in the sink is disposed in the skirt portion at a point remote from the location of the pump retraction cable pulley.

Still further, the sink supporting means preferably includes a plurality of retaining flanges disposed in spaced relation to the bottom wall of the parts washing portion of the sink about the perimeter of the skirt portion of the sink so as to cooperate with a preferably continuous rim of the drum. Then, the opening in the sink can advantageously be disposed in the skirt portion at a level above the retaining flanges, and the pump retraction cable can pass through the opening in the skirt portion of the sink at a point above the continuous rim of the drum.

In the preferred embodiment, the pump discharge tube extends from the pump to a point remote from the opening in the sink. Preferably, the pump discharge tube is a flexible tube having slack therein when the pump retraction handle is in engagement with the sink at the opening. In addition, the pump discharge tube advantageously communicates with a parts washing hose through the skirt portion of the sink.

Additionally, an electrical cord extends from the pump to a point remote from the opening in the sink. The electrical cord is preferably a flexible cord having slack therein when the pump retraction handle is in engagement with the sink at the opening. Further, the electrical cord is designed to pass through a second opening in the skirt portion of the sink.

Other objects, advantages and features of the present invention will become apparent from a consideration of the following specification taken in conjunction with the accompanying drawings.

DETAILED DESCRIPTION OF THE PREFERRED EMBODIMENT

Figure 1A:
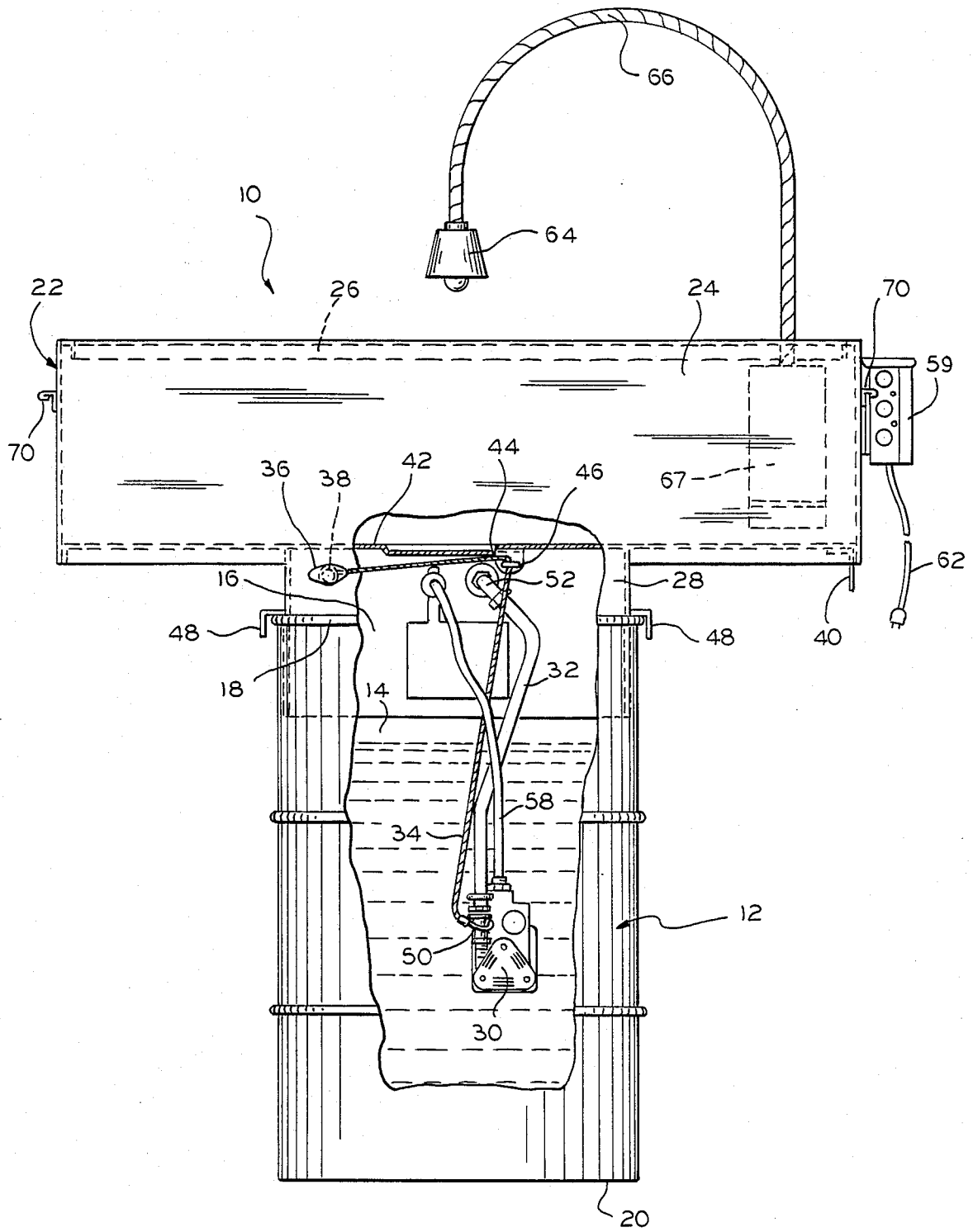
FIG. 1A is a front elevational view showing a parts washer device in accordance with the present invention.

In the drawings, and with reference first to FIG. 1A, the reference numeral 10 designates generally a parts washer device in accordance with the present invention. The parts washer device 10 includes a liquid container 12 preferably in the form of a cylindrical drum adapted to carry a liquid solvent 14 therein and having an open end 16 defined by a rim 18 preferably in the form of a continuous circular rim and a closed end or bottom 20. The parts washer device 10 also includes a tank 22 preferably in the form of a sink adapted to be removably positioned on the drum 12 for the washing of parts wherein the sink 22 includes a generally rectangular part washing portion 24 having a hinged lid 26 thereon which is normally disposed forwardly of a vertical plane at an angle of approximately 12° by means of a fusible link assembly 27 in an open position (see FIG. 4). The parts washer device 10 is designed such that the parts washing portion 24 is adapted to be supported above the open end 16 of the cylindrical drum 12 by means of a cylindrical skirt portion 28 which extends downwardly therefrom in a manner enabling it to fit within the open end 16 of the cylindrical drum 12. The parts washer device 10 further includes an electrical pump 30 (see, also, FIG. 3) mounted on the sink 22 so as to extend through and substantially below the cylindrical skirt portion 28 into the liquid solvent 14 when the sink 22 is supported on the cylindrical drum 12. The parts washer device 10 utilizes the electrical pump 30 which has a flexible pump discharge tube 32 for carrying the liquid solvent 14 from the cylindrical drum 12 to the generally rectangular parts washing portion 24 of the sink 22. Further, and as will be described in greater detail hereinafter, the parts washer device 10 includes means for retracting the electrical pump 30 and the flexible pump discharge tube 32 into the cylindrical skirt portion 28 of the sink 22 and retaining the electrical pump 30 and flexible pump discharge tube 32 within the cylindrical skirt portion 28 of the sink 22 during removal of the sink 22 from the cylindrical drum 12 (see FIG. 1B).

More particularly, the retracting and retaining means includes a pump retraction cable 34 extending from the pump 30 to the sink 22. The pump retraction cable 34 is movable from a pump operative position (FIG. 1A) to a pump retracted position (FIG. 1B) prior to removal of the sink 22 from the drum 12 and, for this purpose, the retracting and retaining means includes means for securing the pump retraction cable 34 in either a pump operative position (FIG. 1A) or a pump retracted position (FIG. 1B) externally of the sink 22 at a point remote from the liquid solvent 14 in the drum 12. More particularly, the cable securing means includes a pump retraction handle 36 secured to the end of the pump retraction cable 34 remote from the pump 30.

Figure 1B:
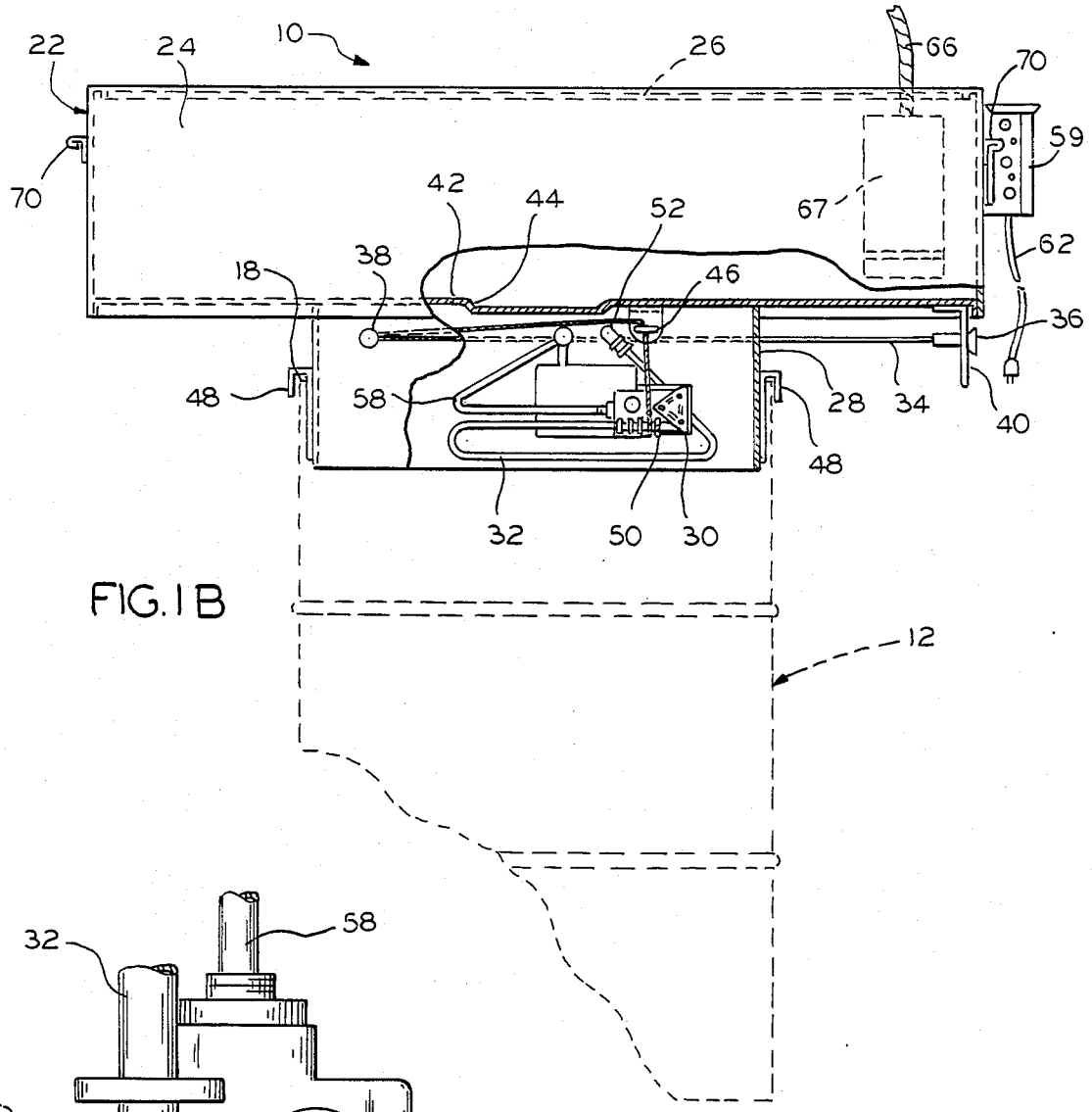
FIG. 1B is a front elevational view similar to FIG. 1A showing a pump and pump discharge tube in a retracted position.
Figure 4:
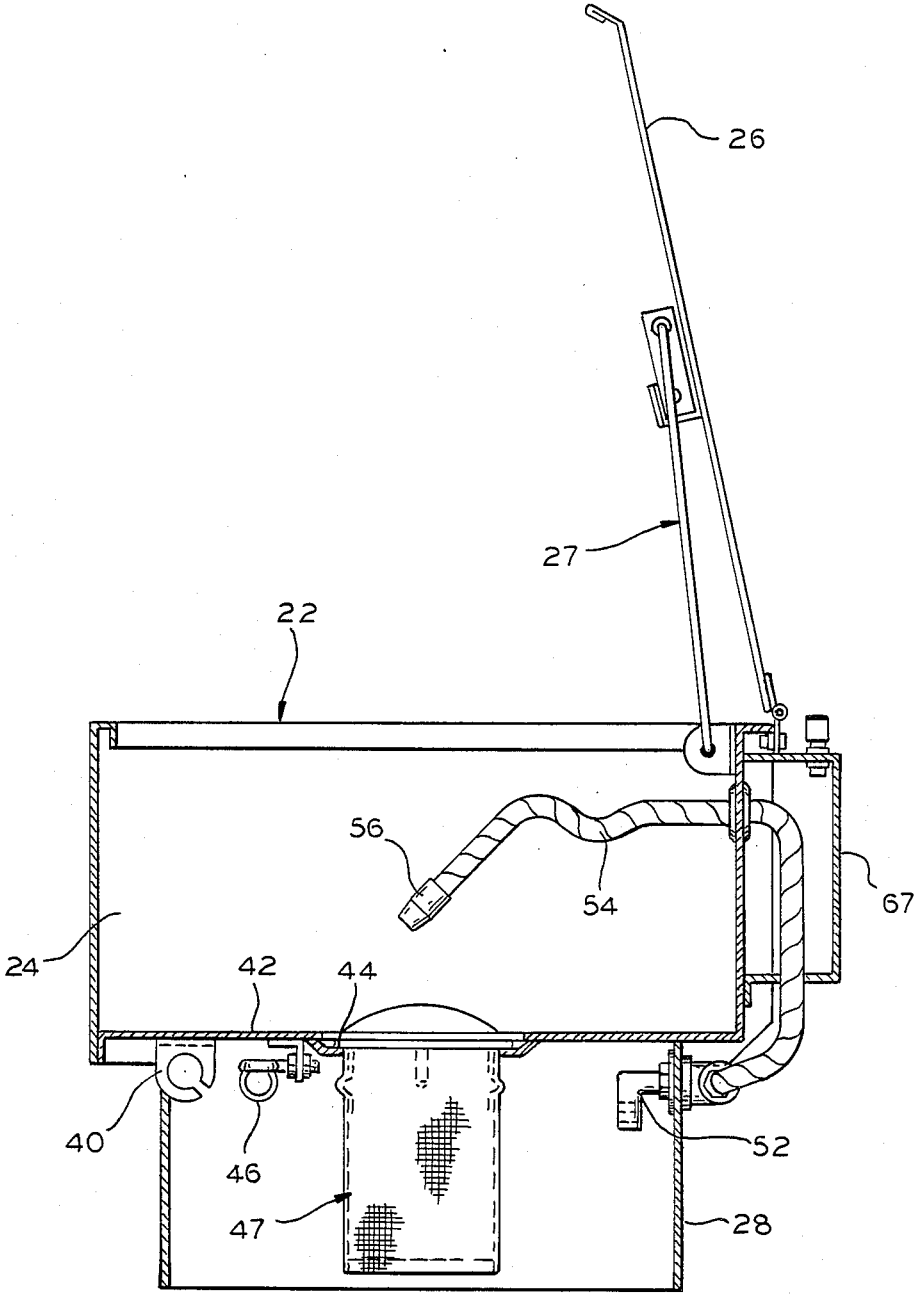
FIG. 4 is a front-to-back cross-sectional view of the parts washer device illustrated in FIGS. 1A, 1B and 2.
Figure 5:
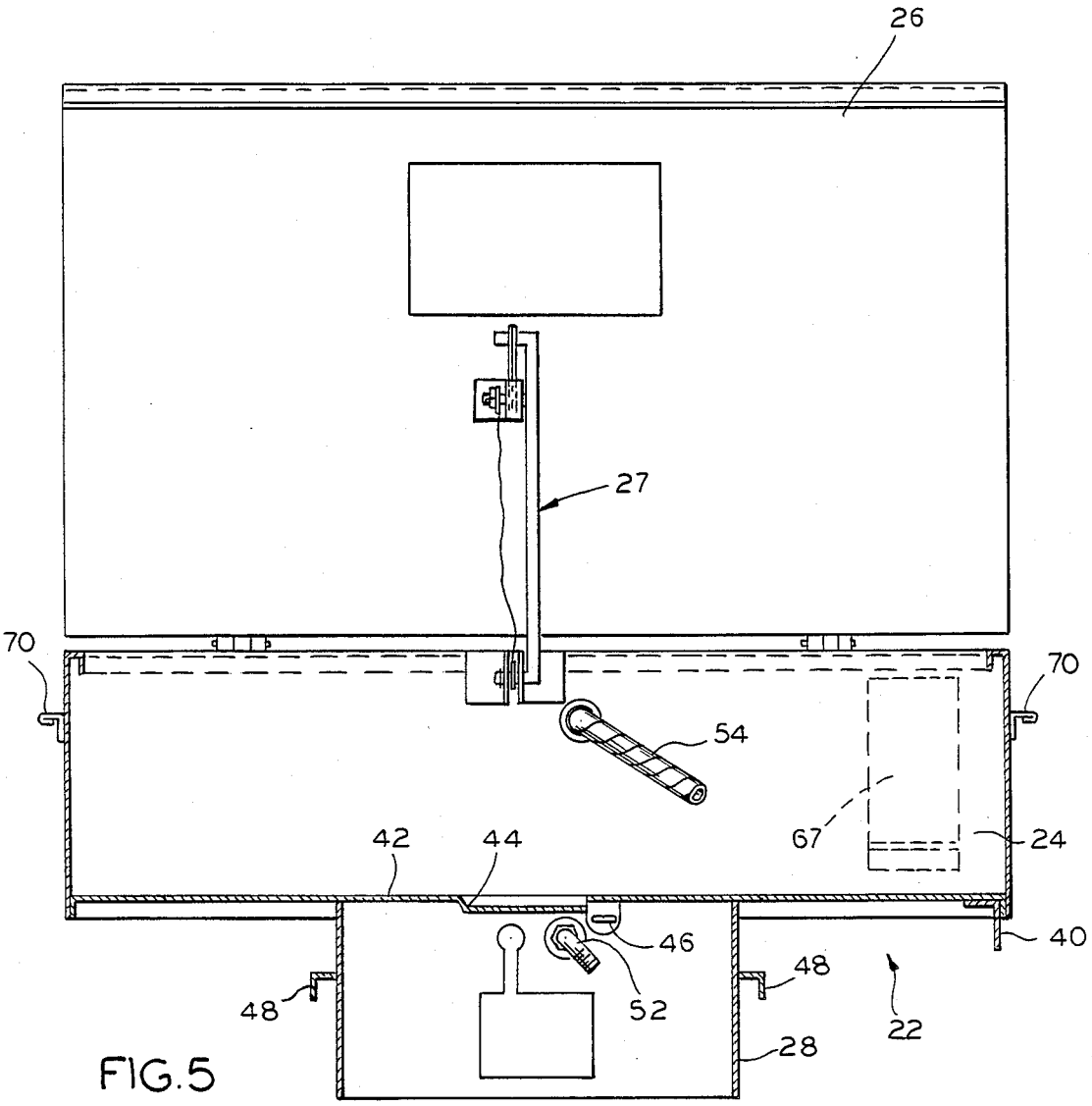
FIG. 5 is a side-to-side cross-sectional view of the parts washer device illustrated in FIGS. 1A, 1B and 2.

Referring to FIGS. 1A, 1B and 4, the pump retraction cable 34 passes through an opening 38 in the sink 22 dimensioned smaller than the pump retraction handle 36. With this arrangement, the pump retraction handle 36 is designed to be in engagement with the sink 22 at the opening 38 when the pump 30 is in the pump operative position (FIG. 1A). In addition, the parts washer device 10 preferably includes handle retention means such as the handle retaining bracket 40 for cooperative engagement with the pump retraction handle 36 when the pump 30 is in the pump retracted position (FIG. 1B). With this arrangement, the handle retaining bracket 40 is integrally associated with the sink 22 in spaced relation to the opening 38. As a result, the pump retraction cable 34 is retractable through the opening 38 to move the pump retraction handle 36 from the opening 38 to the handle retaining bracket 40.

As shown in FIGS. 1A, 1B and 4, the parts washing portion 24 of the sink 22 includes a bottom wall 42 entirely covering the skirt portion 28 and having a centrally disposed drain 44 therein. The parts washer device 10 also includes a pump retraction guide or eye bolt 46 mounted in spaced relation to the centrally disposed drain 44 on the underneath side of the bottom wall 42 within the confines of the skirt portion 28, i.e., within the boundary defined by the perimeter of the skirt portion 28, and the drain 44 preferably includes a filter or strainer basket 47 so that liquid solvent can pass through the centrally disposed drain 44 and the filter or strainer basket 47 back into the drum 12. As shown, the pump retraction cable 34 extends from the pump 30, through the pump retraction guide or eye bolt 46, and through the opening 38 in the sink 22.

Still further, the opening 38 in the sink 22 is preferably disposed in the skirt portion 28 at a point adjacent the location of the pump retraction guide or eye bolt 46. It will also be appreciated that the parts washer device 10 includes sink supporting means in the form of a plurality of retaining flanges 48 disposed in spaced relation to the bottom wall 42 of the parts washing portion 24 of the sink 22 (i.e., vertically downwardly thereof) about the perimeter of the skirt portion 28 of the sink 22 (i.e., a minimum of three retaining flanges 48 disposed in circumferentially spaced relation thereabout) so as to cooperate with the continuous rim 18 of the drum 12. In this manner, the opening 38 in the sink 22 can suitably be disposed in the skirt portion 28 at a point above the retaining flanges 48.

Referring to FIGS. 1A and 4, the pump discharge tube 32 extends from the pump 30 to a point remote from the opening 38 in the sink 22. The pump discharge tube 32 is a flexible tube having slack therein when the pump retraction handle 36 is in engagement with the sink 22 at the opening 38, i.e., the pump retraction cable 34 supports the pump 30 rather than the pump discharge tube 32 thus resulting in no strain on the pump discharge tube 32 or on the fittings 50 and 52 at opposite ends thereof. Moreover, as shown in FIGS. 1A and 4, the pump discharge tube 32 communicates through the skirt portion 28 of the sink 22 by means of the fitting 52 with a parts washing hose 54 having a nozzle 56 thereon.

In addition, the parts washer device 10 suitably includes an electrical cord 58 extending from the pump 30 to a point remote from the opening 38 in the sink 22. The electrical cord 58 is also preferably a flexible cord having slack therein when the pump retraction handle 36 is in engagement with the sink 22 at the opening 38 thereof, i.e., the weight of the pump 30 is supported solely by the pump retraction cable 34 rather than by either the pump discharge tube 32 or the electrical cord 58. Moreover, the electrical cord 58 preferably passes through a second opening 61 in the skirt portion 28 of the sink 22 (see also FIG. 2).

As shown, both the fitting 52 and the second opening 61 will be disposed above the level of the retaining flanges 48, i.e., above the level of the continuous rim 18 of the drum 12, so as to avoid any interference with the drum 12.

Figure 2:
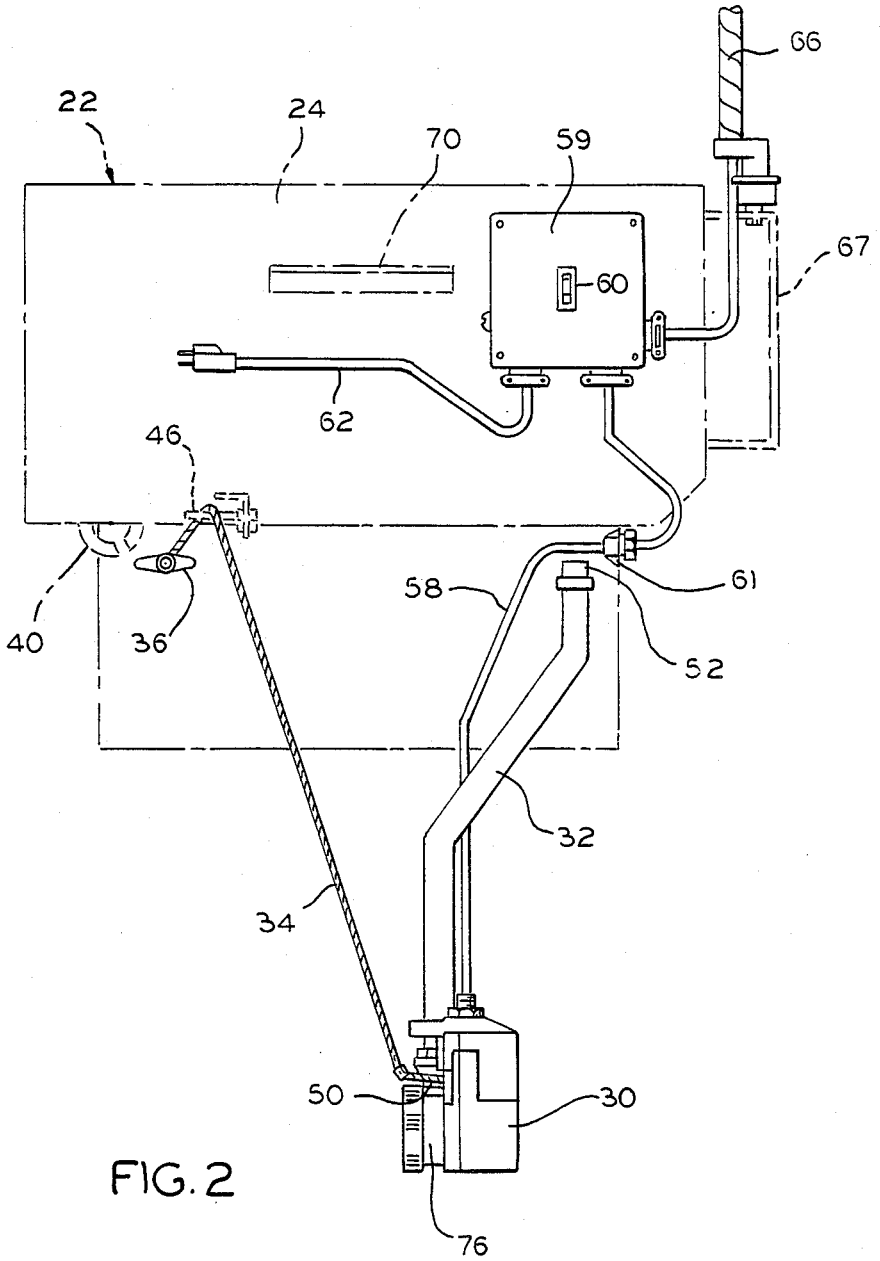
FIG. 2 is an end elevational view illustrating the operative components with the tank shown in phantom lines.

As shown in FIGS. 1A, 1B and 2, the parts washer device 10 also includes a control box 59 mounted on the parts washing portion 24 of the sink 22. The control box 59 has at least one switch 60 (FIG. 2) therein to which the flexible electrical cord 59 from the pump 30 will extend. In addition, the control box 58 has a flexible electrical cord 62 extending from the switch 60 for connection to a source of electricity (not shown).

Also, as shown, the parts washer device 10 includes a lamp 64 mounted on a gooseneck 66 extending from a bracket 67 on the back of the parts washing portion 24 of the sink 22. The lamp 64 is preferably centrally disposed over and above the parts washing portion 24 of the sink 22. In addition, the control box 59 suitably is wired such that the switch 60 also will control the operation of the lamp 64.

For purposes of removing the sink 22 from the drum 12, the parts washing portion 24 of the sink 12 preferably includes a pair of lifting handles 70. One of the lifting handles 70 is advantageously disposed on each of the opposite ends of the parts washing portion 24. With this construction, the lifting handles 70 are adapted to be gripped for removal of the sink 22 from the drum 12.

Figure 3:
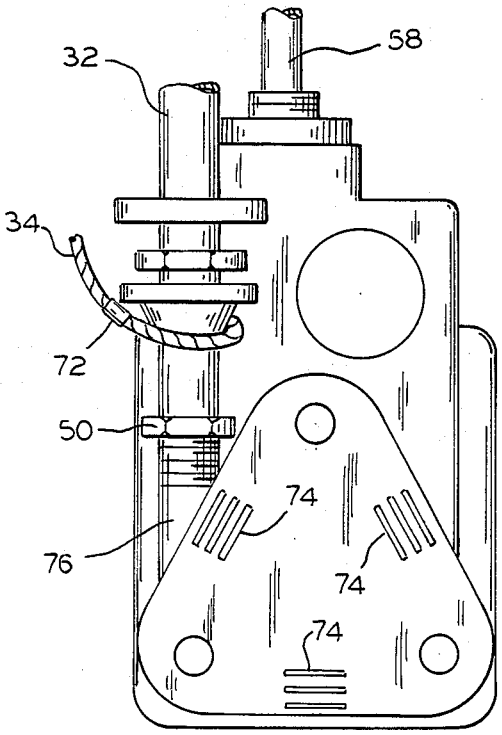
FIG. 3 is an enlarged front elevational view of the pump for the parts washer device illustrated in FIGS. 1A, 1B and 2.

As shown in FIG. 3, the pump retraction cable 34 can be secured to the pump 30 by means of a cable clamp 72, e.g., at the fitting 50. The pump retraction cable 34 in this manner will be secured to the pump 30 in a manner not impeding the operation of the pump inasmuch as there is no interference with either the pump intake openings 74 or with the pump outlet 76 to which the fitting 50 on the pump discharge tube 32 is to be connected. However, while a specific form of cable attachment has been illustrated, it will be appreciated that the invention is not to be limited thereby.

As will now be appreciated, the parts washer device 10 is shown in a pump operative position in FIG. 1A with the pump 30 disposed substantially below the lowermost point of the skirt portion 28 of the sink 22 so as to extend well below the surface of the liquid solvent 14. It will be seen that the pump 30 is advantageously positioned at a point closer to the closed end 20 of the drum 12 than the open end 16 thereof. By reason of the engagement of the pump retraction handle 36 with the skirt portion 28 at the opening 38, the pump 30 is supported in this position by means of the pump retraction cable 34 with slack in both the pump discharge tube 32 and the electrical cord 58.

Figure 6:
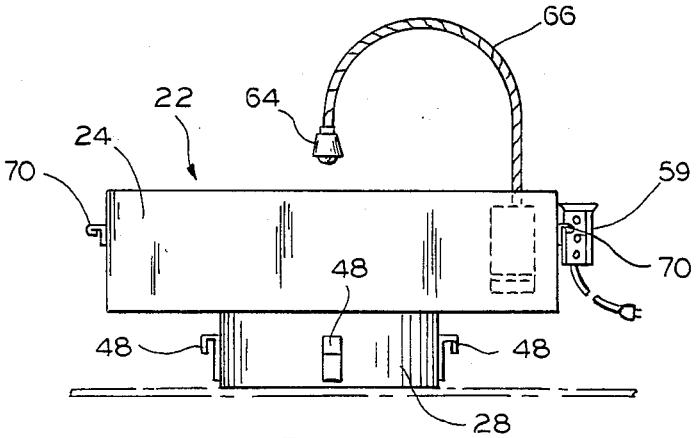
FIG. 6 is a front elevational view of the sink portion of the parts washer device illustrated in FIGS. 1A, 1B and 2.

When it is desired to remove the sink 22 from the drum 12 for servicing the solvent 14, the lid 26 is closed and the electrical cord 62 is disconnected from the source of electricity (see FIG. 1A). Then, the pump retraction handle 36 is gripped and pulled outwardly away from the opening 38 in the skirt portion 28 whereby the pump retraction cable 34 causes the pump 30, pump discharge tube 32, and flexible electric cord 58 to be retracted into the position illustrated in FIG. 1B. Next, the pump retraction handle 36 is moved so as to wrap the pump retraction cable 34 about the outer surface of the skirt portion 28 as shown in FIG. 1B to cooperatively engage the pump retraction handle 36 with the handle retaining bracket 40. At this point, the handles 70 can be utilized to simply lift the sink 22 from the drum 12 for placement of the sink 22 on a flat surface without any possibility of causing damage to any of the pump 30, pump discharge tube 32, or electrical cable 58 all of which are safely disposed within the boundaries defined by the skirt portion 28 of the sink 22 (see FIG. 6).

As will now be appreciated, the present invention accomplishes several distinct and important functions previously unknown. First, it supports a pump in an operative position without strain on a pump discharge tube or an electrical cord by reason of a pump retraction cable and pump retraction handle cooperating to accommodate slack therein. Second, it supports a pump in a retracted position without the possibility of damage to the pump, pump discharge tube or electrical cord by reason of the pump retraction cable and pump retraction handle supporting these components within the confines of the skirt portion of the sink. Third, it facilitates removal of the sink from the drum by greatly reducing the vertical lift of the sink relative to the drum thereby reducing back strain on the operator. As a result, the present invention represents a significant advancement in the parts washer art.

While in the foregoing specification a preferred embodiment of the invention has been set forth for purposes of illustration, it will be appreciated that the details herein given are only to be limited by the spirit and scope of the appended claims.

I claim:

1. A parts washer device, comprising:

a liquid container having an open end and a closed end, said open end being defined by a rim, said liquid container being adapted to carry a liquid solvent therein;

a tank adapted to be removably positioned on said liquid container, said tank including a parts washing portion adapted to be supported above said open end of said liquid container and a skirt portion extending below said parts washing portion and adapted to fit within said open end of said liquid container, and including means for supporting said tank on said liquid container such that parts can be washed therein;

a pump mounted on said tank so as to extend through said skirt portion into said liquid solvent when said tank is supported on said liquid container, said pump including a pump discharge tube for carrying said liquid solvent from said liquid container to said parts washing portion of tank; and means for retracting said pump and said pump discharge tube into said skirt portion of said tank and retaining said pump and pump discharge tube within said skirt portion of said tank during removal of said tank from said liquid container.

2. The parts washer device as defined by claim 1 wherein said retracting and retaining means includes a pump retraction cable extending from said pump to said tank, said pump retraction cable being adapted to move said pump from an operative position to a pump retracted position prior to removal of said tank from said liquid container.

3. The parts washer device as defined by claim 2 wherein said retracting and retaining means includes means for securing said pump retraction cable in either a pump operative position or a pump retracted position externally of said tank at a point remote from said liquid solvent in said liquid container.

4. The parts washer device as defined by claim 3 wherein said cable securing means includes a pump retraction handle secured to the end of said pump retraction cable remote from said pump, said pump retraction cable passing through an opening in said tank dimensioned smaller than said pump retraction handle.

5. The parts washer device as defined by claim 4 wherein said pump retraction handle is in engagement with said tank at said opening when said pump is in said pump operative position, and including handle retention means for engagement with said pump retraction handle when said pump is in said pump retracted position.

6. The parts washer device as defined by claim 5 wherein said handle retention means is integrally associated with said tank in spaced relation to said opening, said pump retraction cable being retractable through said opening to move said pump retraction handle from said opening to said handle retention means.

7. The parts washer device as defined by claim 6 wherein said parts washing portion of said tank includes a bottom wall entirely covering said skirt portion, and including a pump retraction cable pulley mounted on said bottom wall within the confines of said skirt portion.

8. The parts washer device as defined by claim 7 wherein said pump retraction cable extends from said pump, over said pump retraction cable pulley, and through said opening in said tank, said opening in said tank being disposed in said skirt portion at a point remote from the location of said pump retraction cable pulley.

9. The parts washer device as defined by claim 8 wherein said tank supporting means includes a plurality of retaining flanges disposed in spaced relation to said bottom wall of said parts washing portion of said tank about the perimeter of said skirt portion of said tank so as to cooperate with said rim of said liquid container.

10. The parts washer device as defined by claim 9 wherein said pump discharge tube extends from said pump to a point remote from said opening in said tank, said pump discharge tube being a flexible tube having slack therein when said pump retraction handle is in engagement with said tank at said opening.

11. The parts washer device as defined by claim 10 including an electrical cord extending from said pump to a point remote from said opening in said tank, said electrical cord being a flexible cord having slack therein when said pump retraction handle is in engagement with said tank at said opening.

12. The parts washer device as defined by claim 11 wherein said opening in said tank is disposed in said skirt portion at a point above said retaining flanges, said electrical cord passing through a second opening in said skirt portion of said tank, said pump discharge tube communicating with a parts washing hose through said skirt portion of said tank.

13. A parts washer device, comprising:

a cylindrical drum having an open end and a closed end, said open end being defined by a continuous circular rim, said cylindrical drum being adapted to carry a liquid solvent therein;

a sink adapted to be removably positioned on said cylindrical drum, said sink including a generally rectangular parts washing portion having a hinged lid thereon and being adapted to be supported above said open end of said cylindrical drum and a cylindrical skirt portion extending below said generally rectangular parts washing portion and being adapted to fit within said open end of said cylindrical drum, and including means for supporting said sink on said cylindrical drum such that parts can be washed therein;

an electrical pump mounted on said sink so as to extend through and substantially below said cylindrical skirt portion into said liquid solvent when said sink is supported on said cylindrical drum, said electrical pump including a flexible pump discharge tube for carrying said liquid solvent from said cylindrical drum to said parts washing portion of said sink; and means for retracting said electrical pump and said flexible pump discharge tube into said cylindrical skirt portion of said sink and retaining said electrical pump and flexible pump discharge tube within said cylindrical skirt portion of said sink during removal of said sink from said cylindrical drum;

said retracting and retaining means including a pump retraction cable extending from said pump to said sink, said pump retraction cable being movable from a pump operative position to a pump retracted position prior to removal of said sink from said drum;

said retracting and retaining means also including means for securing said pump retraction cable in either a pump operative position or a pump retracted position externally of said sink at a point remote from said liquid solvent in said drum.

14. The parts washer device as defined by claim 13 wherein said cable securing means includes a pump retraction handle secured to the end of said pump retraction cable remote from said pump, said pump retraction cable passing through an opening in said sink dimensioned smaller than said pump retraction handle.

15. The parts washer device as defined by claim 14 wherein said pump retraction handle is in engagement with said sink at said opening when said pump is in said pump operative position, and including handle retention means for engagement with said pump retraction handle when said pump is in said pump retracted position.

16. The parts washer device as defined by claim 15 wherein said handle retention means is integrally associated with said sink in spaced relation to said opening, said pump retraction cable being retractable through said opening to move said pump retraction handle from said opening to said handle retention means.

17. The parts washer device as defined by claim 13 wherein said parts washing portion of said sink includes a bottom wall entirely covering said skirt portion, and having a centrally disposed drain therein, and including a pump retraction cable pulley mounted in spaced relation to said centrally disposed drain on said bottom wall within the confines of said skirt portion.

18. The parts washer device as defined by claim 17 wherein said pump retraction cable extends from said pump, over said pump retraction cable pulley, and through said opening in said sink, said opening in said sink being disposed in said skirt portion at a point remote from the location of said pump retraction cable pulley.

19. The parts washer device as defined by claim 17 wherein said sink supporting means includes a plurality of retaining flanges disposed in spaced relation to said bottom wall of said parts washing portion of said sink about the perimeter of said skirt portion of said sink so as to cooperate with said continuous rim of said drum.

20. The parts washer device as claimed by claim 19 wherein said opening in said sink is disposed in said skirt portion at least at a point above said retaining flanges, and including an electrical cord extending from said pump to a point remote from said opening in said sink and passing through a second opening in said skirt ortion of said sink, said pump discharge tube communicating with a parts washing hose through said skirt portion of said sink.

21. The parts washer device as defined by claim 14 wherein said pump discharge tube extends from said pump to a point remote from said opening in said sink, said pump discharge tube having slack therein when said pump retraction handle is in engagement with said sink at said opening.

22. The parts washer device as defined by claim 21 including an electrical cord extending from said pump to a point remote from said opening in said sink, said electrical cord being a flexible cord having slack therein when said pump retraction handle is in engagement with said sink at said opening.

23. The parts washer device as defined by claim 13 including a control box mounted on said parts washing portion of said sink, said control box having a switch therein and having a flexible electrical cord extending from said switch to said pump, and including a flexible electrical cord extending from said switch to a source of electricity.

24. The parts washer device as defined by claim 23 including a lamp mounted on a gooseneck extending from said parts washing portion of said sink, said lamp being centrally disposed over and above said parts washing portion of said sink.

25. The parts washer device as defined by claim 13 wherein said parts washing portion of said sink includes a pair of lifting handles, one of said lifting handles being disposed on each of opposite ends thereof, said lifting handles being adapted to be gripped for removal of said sink from said drum.

* * * * *